United States Patent [19]

Bryden

[11] 4,346,536

[45] Aug. 31, 1982

[54] TILTING ARBOR BELT SANDER

[76] Inventor: Norman E. Bryden, 2407 Arden Dr., Champaign, Ill. 61820

[21] Appl. No.: 222,690

[22] Filed: Jan. 5, 1981

[51] Int. Cl.[3] ..... B24B 21/00

[52] U.S. Cl. ..... 51/135 R; 51/166 TS

[58] Field of Search ..... 51/147, 135 R, 166 TS

[56] References Cited

U.S. PATENT DOCUMENTS 1,956,985 5/1934 Edwards ..... 51/135 R 2,857,717 10/1958 Edgemond ..... 51/135 R

*Primary Examiner*—Harold D. Whitehead

*Attorney, Agent, or Firm*—David V. Munnis

[57] ABSTRACT

Belt sanding apparatus including a frame having parallel, spaced horizontal tubular elements, mounting head elements which are slideably positioned on the horizontal tubular elements, table members pivotally attached to vertical tubular elements adjustably mounted in the mounting head elements, the table members being adjustable as to fixed positions relative to horizontal about an axis perpendicular to the horizontal tubular elements of the frame, and a sanding mechanism, mounted upon an arbor element which is pivotally attached also to vertical tubular elements adjustably mounted in another mounting head element, the arbor element being adjustable as to fixed positions relative to horizontal, with the sanding mechanism including a rotatable sanding belt, a guide for the sanding belt adapting the belt to travel an extended path transversely of the horizontal tubular elements of the frame, and further including the motor drive for the sanding belt, whereby the apparatus is adapted to expose the edge of a work-piece, e.g., a flat wooden board, placed upon one of the table members to varying vertical angles of contact, i.e., from zero to 90 degrees, with the rotating sanding belt to sand the work-piece in a direction transversely of the horizontal tubular elements of the frame.

2 Claims, 5 Drawing Figures

FIG. 1
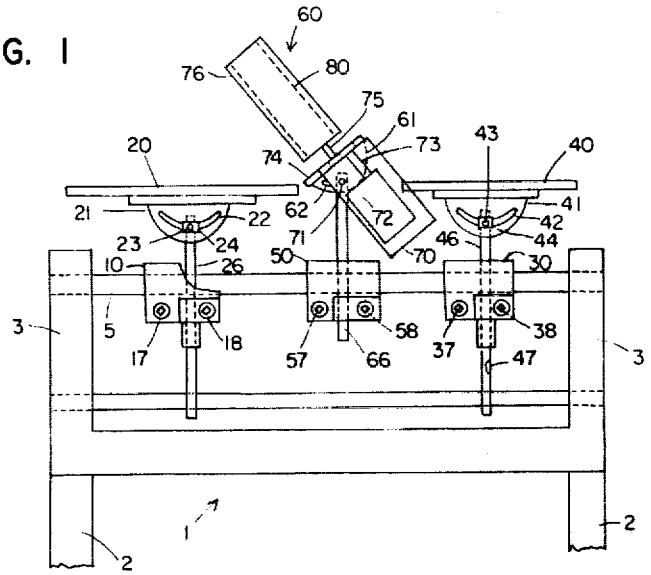
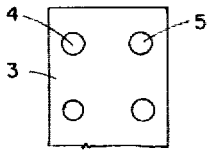
FIG. 2
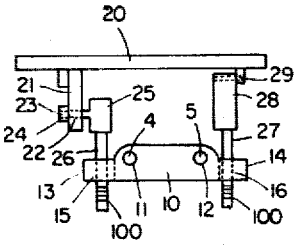
FIG. 3
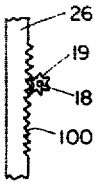
FIG. 4
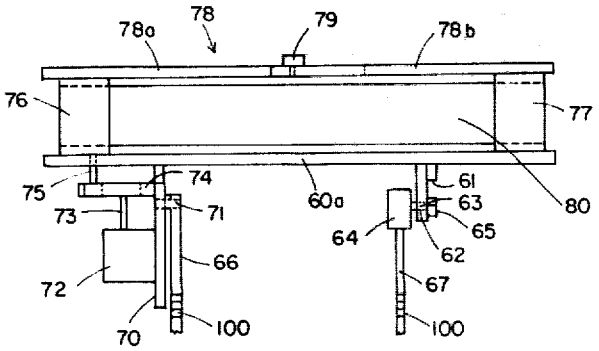
FIG. 5

TILTING ARBOR BELT SANDER

BACKGROUND OF THE INVENTION

This invention relates to a tilting arbor belt sanding machine, and more particularly to a sanding machine in which the rotating belt and motor drive motor means therefore are mounted upon an arbor which is pivotally supported to allow the sanding belt to be employed to sand the edge of work-pieces at varying angles with the sanding belt contacting the edges of same longitudinally thereof.

Sanding devices utilizing mechanically rotated belts have long been known, including those which are totally portable, partially adjustable by hand by an operator, and adjustable to a predetermined fixed position at which no further manual handling, other than of a work-piece being sanded by the apparatus, is involved. Examples of such prior sanding machines are those shown in U.S. Pat. Nos. 1,798,421; 2,724,934; and 3,133,384.

Previously suggested belt sanding devices, however, have not proved to be completely satisfactory, particularly in the production of precision and/or repetitive finished work-pieces, due to devices employing any manual positioning of the sanding belt during the sanding operation failing to effect uniform and/or the particular material removal results and/or even damaging the work-piece surface or edges by being adapted only to abrade the work-piece perpendicular to the edge of same; and due to devices having an adjustable feature being merely similarly adapted to abrade perpendicular to the work-piece edge, resulting in work damage, and/or being lacking in suitable ranges of adjustability in terms of treatable angles and belt speed maintenance to achieve commercially acceptable versatility.

Hence, a search has continued in the art for an improved edge, belt sander.

OBJECTS OF THE PRESENT INVENTION

Accordingly, the primary object of the present invention is to provide an improved belt sander.

Another object of the present invention is to provide an improved belt sander which is useful as a work-piece edge sander and which advantageously reduces or eliminates the drawbacks characterizing prior art belt sanders.

An additional object of the present invention is to provide a novel belt sander which advantageously is more efficient as a work-piece edge sander as compared to prior art belt sanders.

A further object of the present invention is to provide a novel belt sander which advantageously is more versatile as a work-piece edge sander as compared to prior art belt sanders.

Yet another object of the present invention is to provide a novel belt sander which advantageously is adapted to efficiently be utilized as a work-piece edge sander at adjustable operating angles ranging between zero and 90 degrees.

A particular object of the present invention is to provide a novel belt sander which advantageously is adapted to efficiently and uniformly effect sanding of an edge of a work-piece at varying angles in a direction longitudinally of the work-piece's edge being treated.

An additional particular object of the present invention is to provide a novel belt sander which advantageously is adapted to effect efficient and uniform sanding of an edge of a work-piece at a pre-determined angle with little or no damage to the work-piece face as compared to previously available belt sanders.

DESCRIPTION OF ACCOMPANYING DRAWINGS

The above and other objects are achieved and are features of the tilting arbor belt sanding apparatus of the present invention which shall be described below in greater detail with particular reference being made to the accompanying drawings of which:

FIG. 1 is a diagrammatic side view, partially broken away, of an embodiment of the belt sanding apparatus of the present invention;

FIG. 2 is a partial end view of the device shown in FIG. 1;

FIG. 3 is a partial end view illustrating the mounting of the table members of the device shown in FIG. 1;

FIG. 4 is a partial diagrammatic side view illustrating an embodiment of the height adjustment means utilized in adjusting the vertical positioning of the tables and belt-carrying arbor of the sanding apparatus of the present invention; and FIG. 5 is a partial diagrammatic side view illustrating the mounting of the belt sanding mechanism on the arbor element and the mounting of the belt-carrying arbor element of the embodiment of the present device shown in FIG. 1.

DESCRIPTION OF SPECIFIC EMBODIMENTS

With reference to the accompanying drawings in which like numerals refer to like elements, in FIG. 1, numeral one generally designates the frame of an embodiment of the belt sanding apparatus shown therein, with frame 1 having leg members 2 and vertically extending end flanges 3 between which are disposed and supported a pair of spaced parallel horizontal tubular elements 4 and 5, as more clearly shown in FIGS. 2 and 3.

In accordance with the present apparatus, three mounting head elements 10, 50 and 30 are positioned, in spaced relationship to each other, on tubular elements and adapted for slideable engaging movement with and along tubular elements 4 and 5, with head elements 10, 50 and 30 each being provided with means for releaseably fixing the same in desired variable positions longitudinally of tubular elements 4 and 5. Such locking means for head elements 10, 50 and 30 suitably may be any conventionally available means for fixing in place a member sliding over a rod, e.g., means operating by a set-screw mechanism, operating by a deflection of a split section of the sliding element, operating by a tightening of a separate band element provided, etc., or operating by movement of a rotatable cam-carrying rod, i.e., cam-carrying rod elements having recessed heads for receiving a cooperating tool to operate same, as are represented by such cam-carrying rods having such recessed heads designated numerals 17, 57 and 37, respectively, for releaseably fixing heads 10, 50 and 30 in FIG. 1.

In accordance with the present invention, each of mounting head elements 10, 50 and 30 is further provided with a pair of spaced vertical openings therein, represented by openings 15 and 16 in side flanges 13 and 14 of head element 10, as shown in FIG. 3, (head elements 50 and 30 have similar side flanges with vertical openings therein) and with a pair of spaced, parallel vertical tubular elements, represented by tubular elements 26 and 27, as shown in FIG. 3, which are received in slideable engagement within such vertical openings in the head elements; head element 30 is provided with similar vertical tubular elements corresponding to tubular elements 26 and 27 of head 10, i.e., tubular element 46 of such pair provided for head 30 is shown in FIG. 1; and head element 50 is provided with similar vertical tubular elements 66 and 67, as shown in FIGS. 1 and 5.

Each of mounting head elements 10,50 and 30 is further provided with means for adjusting and releasably fixing the respective pair of vertical tubular elements located thereon in a particular desired vertical location. Such fixing and locking means suitably may be the same as or different from that utilized with respect to the horizontal movement of heads 10, 50 and 30, but preferably is one, such as shown in FIGS. 1 and 4, with respect to head element 10, including a rotatable rod element (e.g., rod element 18) having teeth (e.g., teeth 19) which are adapted to cooperate and mesh with teeth 100 provided on the respective vertical tubular element (e.g., tubular element 26) when operated by a cooperating tool fitted into a recessed head provided on such rod element. Such similar adjusting means for the vertical tubular elements of heads 50 and 30, as shown in FIG. 1, are designated by numerals 58 and 38, respectively. Alternatively, such adjustment means suitably may be substituted with ratchet-pawl mechanism, not shown.

In accordance with the present invention, each of mounting head elements 10 and 30, i.e., the head elements adjacent the ends of frame 1, has attached to and above the same, through the respective pair of vertical tubular elements thereof, i.e., tubular element pair 26,27 and tubular element pair 46 and the counterpart to element 27, a table member, i.e., table members 20 and 40, respectively, with the table members being so attached that they are pivotally connected to be adapted to pivot about a horizontal axis in each case which is transversely perpendicular to horizontal tubular elements 4 and 5. Further, each of table members 20 and 40 is provided with means for releaseably fixing the particular angular positioning thereof, as desired, relative to horizontal.

Any conventional attachment means which provides such positioning and pivotability of table members 20 and 40 is suitable for utilization. A preferred attachment means, however, for both table members 20 and 40 is that illustrated in FIGS. 1 and 3, the latter showing table member 20 specifically. In such attachment, a flange element on one side of table member extends below the same and is pivotally connected through horizontal pin 29 to a cap element 28 on vertical tubular element 27; a flange plate element 21 extends below the other side of table member 20 and is pivotally connected to a cap element 25 on vertical tubular element 26 through a pin 23 fixed on cap element 25. Flange plate 21 has an arcuate slot 22 provided therein through which pin 23 extends so that the end thereof is received by a locking member, e.g., locking nut 24, which is adapted to releaseably fix flange 21 (and consequently table member 20) in the desired angle of pivotal movement about pin 29 relative to horizontal. Table member 40 is provided with similar connection means, ie., as shown having corresponding elements to those of table 20 represented by numerals increased in magnitude by a value of twenty, e.g., table member 40 has a flange plate 41 having an arcuate slot 42 corresponding to the flange plate 21 with arcuate slot 22 of table member 20, etc.

In accordance with the present invention, the middle mounting head element, i.e., head element 50, has attached above and to the same through vertical tubular elements 66 and 67 thereof, an arbor element, i.e., beam element **60*a* shown in FIG. 5, which is so connected to be adapted for pivotal movement about a horizontal axis transversely perpendicular to horizontal tubular elements 4 and 5 of frame 1**, with such arbor element being provided with means for releaseably fixing the particular angular positioning thereof relative to horizontal, as desired.

In the present invention, such mounting of the arbor element is achieved by providing a flange plate 70 which extends below one side of arbor element **60*a*, as per FIG. 5, and which is pivotally connected through horizontal pin 71 to the upper portion of vertical tubular element 66; a flange element 61 extends below the other side of arbor 60*a* and is pivotally connected to a cap element 64 on vertical tubular element 67 through a pin 63 fixed on cap 64. Flange plate 61, similarly to plates 21 and 41, has an arcuate slot 62 provided therein through which pin 63 extends to be received by a suitable locking means, e.g., locking nut 65, so that locking means 65 is adapted to releaseably fix flange plate 61 (and consequently arbor beam 60*a*) in the desired angle of pivotal movement about pin 71** relative to horizontal.

In accordance with the present invention, a sanding mechanism, designated generally numeral 60 in FIG. 1, is mounted on and moveable with arbor element **60*a*, with the sanding mechanism, as shown more specifically in FIG. 5, including a rotatable sanding belt 80, guide means for the belt 80, i.e., end guide means 76 housing a drive roller and end guide means 77, removed from end guide 76, housing an idler roller, with longitudinal plate guide means being positioned beneath the longitudinal surfaces of belt 80 in conventional manner, not shown. The top plate 78 of sander mechanism 60 may be divided into two telescoping sections, e.g., section 78*a* which is fixed to end housing 76 and section 78*b* which is fixed to end housing 77 which is adapted to slide on arbor 60*a*, so that belt 80 may be tightened in position when placed in the mechanism and/or variable lengths of belts 80 may be utilized; with sections 78*a* and 78*b* in the desired locations they may be anchored by suitable means, e.g., locking screw means 79**.

It is a feature of the sanding apparatus of the present invention that sanding mechanism 60 mounted on the arbor element thereof also includes the motor means, i.e., motor 72, for driving sanding belt 80. In the preferred embodiment of the present invention motor 72, as shown in FIGS. 1 and 5, is positioned on flange plate 70 of arbor **60*a*, so to be moveable therewith, with the output shaft 73 of motor 72 being operably connected to rotate a shaft 75 of the drive roller for belt 80 in housing 76, with shafts 73 and 75 preferably being connected through a suitable transmission means, e.g., gear box 74, to facilitate separation of the elements of the mechanism for repair, and the like. Motor 72 is operatively connected to a conventional power source, e.g., a source of A.C. electrical energy and the like, not shown, by conventional lines and switches; although it will be understood that motor 72 is not limited to one driven by electrical power and can be adapted to be driven by any alternative power, e.g., by hydraulics, conveniently available. Motor 72 may be adapted, as desired, with conventional means, e.g., variable controls, such as rheostats and the like, not shown, so that the speed of belt 80** may be varied.

In operation, the particular table member 20 or 40 on which a given work-piece is to be placed for treatment is adjusted as to the desired horizontal positioning by movement of its respective mounting head 10 or 30 along horizontal tubular elements 4 and 5, and adjusted as to the desired vertical height by raising or lowering its vertical tubular elements, and then adjusted as to desired angular positioning relative to horizontal, as above described. Sanding belt 80 is then adjusted as to the desired horizontal, vertical, and angular positioning as hereinabove described to align the belt to expose the work-piece to the desired angle of contact therewith.

By means of the present invention, a work-piece advantageously can be exposed to the sanding belt 80 rotating about a path extending parallel to the widths of tables 20 and 40 and transversely of tubular elements 4 and 5 whereby and edge of the work-piece is sanded uniformly and longitudinally of its edge, thereby reducing and minimizing damage to the work-piece's faces which is characteristic of belt sanders previously available. Advantageously, by adjusting the positions of tables 20 or 40 and arbor 60*a*, the vertical angle sanding belt 80 may contact a work-piece may vary between zero and 90 degrees. The instant sanding apparatus, hence, advantageously is significantly more versatile than prior sanders. By means of mounting motor 72 so that it, and its connection with axle 75 driving belt 80, remain in uniform positioning with respect to sanding belt 80, the present sanding device further is advantageously characterized by an ability fo produce more uniform results with reduced stress and wear in the power train of the mechanism.

What is claimed is:

1. A belt sanding apparatus comprising:

(a) a frame, including a pair of spaced, parallel, horizontal tubular elements disposed adjacent the top of said frame, (b) three mounting head elements positioned on said pair of horizontal tubular elements of said frame and adapted for slideable engaging movement with and along said horizontal tubular elements, said mounting head elements including means for releaseably fixing same in particular positions longitudinally of said horizontal tubular elements, said mounting head elements each being provided with spaced, vertical openings therein and with a pair of spaced, parallel, vertical tubular elements which are received in slideable engagement within said vertical openings, each of said mounting head elements being provided with means for adjusting and releaseably fixing the respective pair of vertical tubular elements located thereon in a particular vertical location, (c) a table member attached above and to each of the respective two mounting head elements adjacent the ends of said frame, each of said table members being attached to said mounting head elements through the respective vertical tubular elements thereof and being adapted for pivotal movement about a horizontal axis perpendicular to said horizontal tubular elements of said frame, each of said table members being provided with means for releaseably fixing the particular angular positioning thereof relative to horizontal, (d) an arbor element attached above and to the middle of said mounting head elements, said arbor element being attached to said mounting head element through said vertical tubular elements thereof and being adapted for pivotal movement about a horizontal axis perpendicular to said horizontal tubular elements of said frame, said arbor element being provided with means for releaseably fixing the particular angular positioning thereof relative to horizontal, (e) a sanding mechanism mounted on and moveable with said arbor element, said sanding mechanism including a rotatable sanding belt, guide means for said sanding belt adapting said sanding belt to rotate about a path including an extended path parallel to the widths of said table members and transversely of said horizontal tubular elements of said frame, and motor means for driving said sanding belt, said sanding mechanism being adapted to expose the edge of a flat work-piece positioned on one of said table members to varying vertical angles of contact with said sanding belt to sand said work-piece in a direction transversely of said horizontal tubular elements of said frame.

2. The belt sanding apparatus according to claim 1 wherein said vertical angle said sanding belt is adapted to contact said work-piece is variable between zero and 90 degrees.

* * * * *